United States Patent [19]

Kofoid

[11] 4,216,000

[45] Aug. 5, 1980

[54] RESISTIVE ANODE FOR CORONA DISCHARGE DEVICES

[75] Inventor: Melvin J. Kofoid, Seattle, Wash.

[73] Assignee: Air Pollution Systems, Inc., Kent, Wash.

[21] Appl. No.: 960,923

[22] Filed: Nov. 15, 1978

Related U.S. Application Data

[63] Continuation-in-part of Ser. No. 784,196, Apr. 18, 1977, abandoned.

[51] Int. Cl.[2] ..... B03C 3/12

[52] U.S. Cl. ..... 55/138; 55/106; 55/117; 55/146; 55/155; 55/156; 55/157; 361/230

[58] Field of Search ..... 55/11, 117, 130, 135, 55/138, 146, 154–157, 106; 361/126, 230; 313/107; 338/308; 174/28, 126 C, 127, 137 A, 137 B, 138 C, 140 C, 141 C

[56] References Cited

U.S. PATENT DOCUMENTS

| | | | |
|---|---|---|---|
| 1,325,124 | 12/1919 | Strong | 55/155 |
| 1,541,677 | 6/1925 | Anderson | 55/130 |
| 2,351,089 | 6/1944 | Abbey | 55/155 |
| 2,535,697 | 12/1950 | Roos | 55/155 |
| 2,574,284 | 11/1951 | Prochiazka | 55/155 |
| 2,978,066 | 4/1961 | Nodolf | 55/155 |
| 3,081,215 | 3/1963 | Held et al. | 55/155 |
| 3,190,827 | 6/1965 | Kok et al. | 55/155 |
| 3,261,082 | 7/1966 | Maissel et al. | 338/308 |
| 3,278,673 | 10/1966 | Gore | 174/127 |
| 3,289,392 | 12/1966 | Fowler | 55/155 |
| 3,487,610 | 1/1970 | Brown et al. | 55/130 |
| 3,515,909 | 6/1970 | Trump | 310/6 |
| 3,582,206 | 6/1971 | Bordige | 55/155 |
| 3,627,905 | 12/1971 | Astle-Fletcher | 174/140 C |
| 3,678,653 | 7/1972 | Buschman | 55/146 |
| 3,729,575 | 4/1973 | Harding et al. | 174/138 R |
| 3,742,680 | 7/1973 | Severs | 55/155 |
| 3,823,334 | 7/1974 | Philofsky et al. | 174/127 |
| 3,918,939 | 11/1975 | Hardt | 55/117 |
| 4,077,782 | 3/1978 | Drummond et al. | 55/155 |
| 4,108,615 | 8/1978 | Satterthwaite | 55/2 |
| 4,112,193 | 9/1978 | Higuchi et al. | 174/137 A |

FOREIGN PATENT DOCUMENTS

| | | | |
|---|---|---|---|
| 631167 | 11/1961 | Canada | 55/154 |
| 2424616 | 12/1975 | Fed. Rep. of Germany | 174/137 B |
| 716622 | 10/1954 | United Kingdom | 55/130 |
| 482126 | 12/1976 | U.S.S.R. | 174/137 B |

OTHER PUBLICATIONS

The Condensed Chemical Dictionary, Van Nostrand Reinhold, Eighth Edition, p. 37.

Cobine, James D., Gaseous Conductors, 1941, p. 143.

H. White, Resistivity Problems in Electrostatic Precipitation, Journal of APCA, vol. 24, 1974, pp. 336–337.

Dielectrics in 1962, Electro-Technology, 1963 by C-M Technical Publications Corporation.

*Primary Examiner*—David L. Lacey

*Attorney, Agent, or Firm*—Seed, Berry, Vernon & Baynham

[57] ABSTRACT

A resistive anode for use in a corona discharge device principally in the charging stage or collecting stage of a two-stage electrostatic precipitator, or in a single stage electrostatic precipitator. The resistive anode suppresses, i.e. lessens the severity of, back corona and prevents sparkover being produced by dielectric breakdown of particle layers which normally build up on the anode. The resistive anode is formed by a conductive electrode covered with a coating of resistive material having a primary layer of at least 0.25 mm thick in which the material has a high dielectric strength, is homogeneous within specified limits and has a predetermined resistivity. A resistive anode of this construction may be employed in a variety of electrode designs including conventional wire-plate and wire-cylinder configuration, as well as in high intensity ionizers utilizing a planar discharge electrode concentrically mounted in a tubular anode.

46 Claims, 16 Drawing Figures

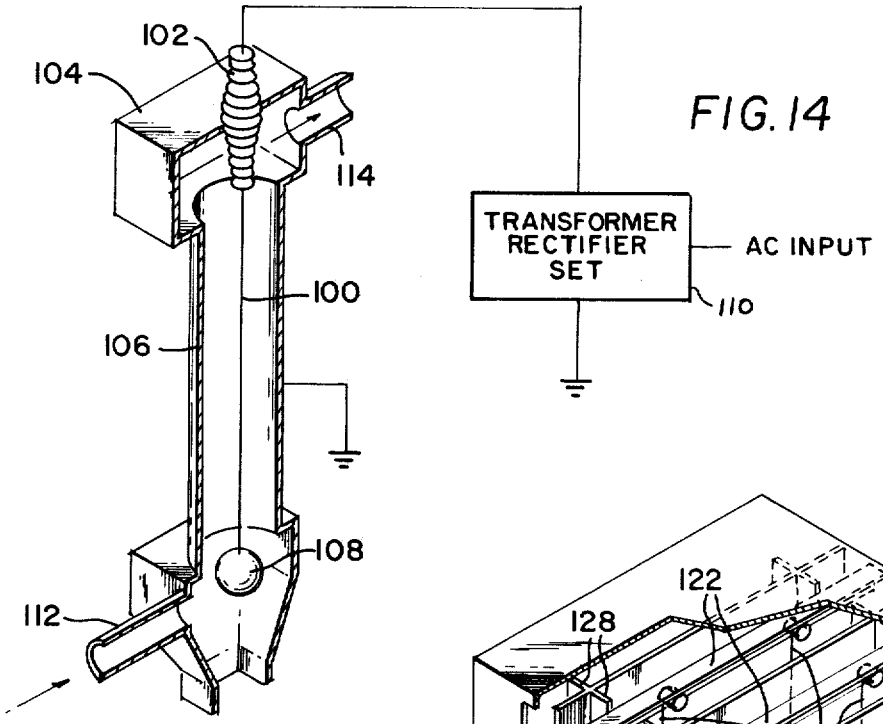
FIG. 14
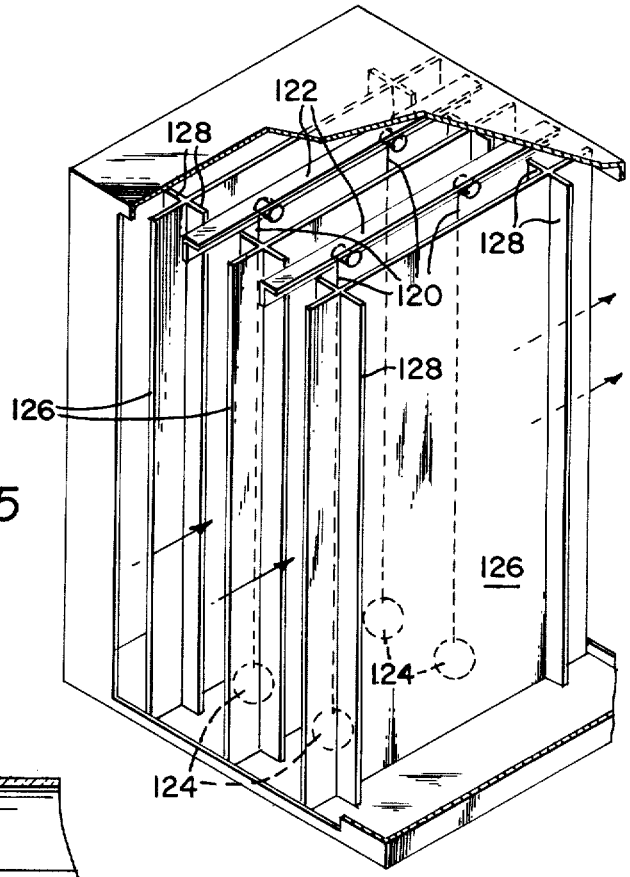
FIG. 15
FIG. 16
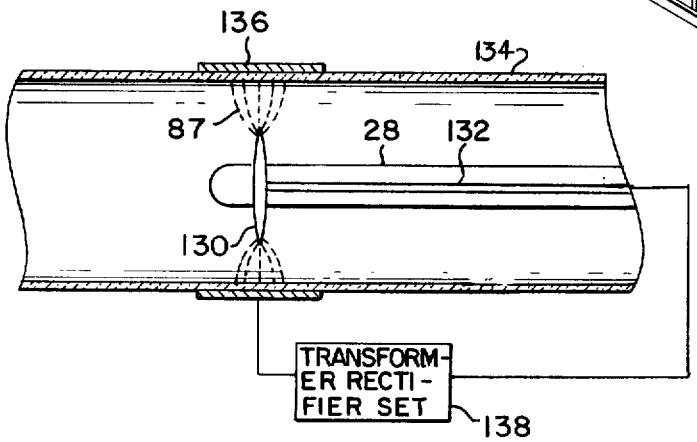

RESISTIVE ANODE FOR CORONA DISCHARGE DEVICES

CROSS-REFERENCE TO RELATED APPLICATION

This is a continuation-in-part of application Ser. No. 784,196, filed Apr. 18, 1977 and now abandoned.

BACKGROUND OF THE INVENTION

1. Field of the Invention

This invention relates to a practical means for allowing greatly increased corona currents to flow between the electrodes of corona discharge devices, particularly where sparkover and/or back corona may be a problem such as in electrostatic precipitation of high resistivity particles entrained in a gas stream. More specifically, the invention is directed to a resistive coating on a passive electrode having a surface layer of at least 0.25 mm thick, in which the coating is substantially homogeneous and has a volume resistivity and dielectric strength within specified ranges for suppressing back corona and preventing sparkover. The invention also can be used to prevent sparking in corona discharges where there is no foreign material on the anode surface.

2. Description of the Prior Art

Standards for emissions of particulate in flue gases issuing from coal fired electrical power station stacks are becoming increasingly more stringent. Current air quality standards require that more than 99% of the fly ash produced by burning coal be removed prior to discharge of the combustion gases from the stack. Thus, the efficiency of particulate collection must increase in proportion to the ash content of the coal. In addition, in an effort to reduce the emissions of certain gaseous pollutants, particularly the sulphur oxides, it has become increasingly necessary to use low sulphur coal in electrical power generating plants.

The electrostatic precipitator is the most commonly used device for the removal of particulate matter produced by coal fired power plants. In a two-stage electrostatic precipitator the particulate-laden gas sequentially passes through separate charging and collecting stages. In the charging stage the gases pass through a corona discharge so that the particulate matter leaving the charger has a negative charge. The charged particles then pass through a low intensity electric field in the collecting stage which causes the particles to migrate toward a collecting electrode where they are deposited and are subsequently removed and disposed of by various techniques. In a single-stage precipitator, particles flowing between a pair of electrodes having a corona current producing electrostatic field extending therebetween are first charged and then migrate toward one of the electrodes where they agglomerate and are subsequently removed. Thus, in a single-stage precipitator both the charging stage and the collecting stage are combined into a single unit. The efficiency of an electrostatic precipitator is determined to a large extent by the magnitude of the charge placed on the particulate matter by the charging stage. The charge magnitude may be increased by increasing the intensity of the electrostatic field producting the corona discharge. The useful maximum intensity of the electrostatic field is limited to a value at which extremely intense back corona or sparkover occurs as the particulate matter builds up on the passive or non-corona emitting electrode. Back corona exists because in operation there will always be some coating of a particulate layer such as fly ash on the surface of the anode. The current flowing to the anode produces a sufficiently high voltage across the fly ash or other particulate layer to cause electrical breakdowns in it. The intense local ionization in the electrical arc in the breakdown channel causes the ejection of products of ionization into the high-intensity corona discharge field resulting in the triggering of a spark. Although back corona effects can be reduced to some extent by such techniques as limiting the thickness of the particulate layer on the passive electrode, electrostatic field intensities achievable with these techniques nevertheless provide limited particle charging. Thereafter, the collection efficiency must be improved by increasing the residence time of the particulate-matter in the electric field during collection either by reducing the speed at which the particulate-laden gases pass through the collection stage, or by increasing the length of the collection stage. However, a decrease in transit speed through the collection stage reduces the capacity of the collection stage, and increasing the size of the collecting electrodes increases the capital cost of such equipment.

The intensity of the electrostatic field at which the charger can operate without back corona and sparkover is lower for higher resistivity particulate matter. Since fly ash resistivity is inversely related to the level of combustible sulphur in coal, the increasing use of low sulphur coals increases the cost of achieving a high collection efficiency since back corona and sparkover problems are increased. Other particulates, such as those generated by cement producers, also have high resistivities which interfere with the operation of precipitators in which they are collected.

Attempts have been made to reduce the incidence of back corona and sparkover in order to increase the intensity of electrostatic fields in ionizers through a number of techniques none of which are entirely satisfactory. Earliest attempts, as described by H. J. White, *Industrial Electrostatic* Precipitation at page 328, Addison-Wesley 1963, were directed to treating the particulate matter before entering the ionizer. High resistivity particulate matter was generally treated by moisture and acid conditioning. Other techniques attempted to prevent the buildup of a layer of particulate material on the passive electrode such as by employing moving belt electrodes, rotating brushes and various other mechanical devices. These later techniques generally failed since even thin films of particulate matter can produce servere back corona effects if the resistivity of the particulate matter is sufficiently high. However, particulate matter buildup has been successfully prevented to some extent by continuously flushing the passive electrode with a water film. Still another approach attempts to adjust the temperature of the electrodes or the gas upwardly and downwardly in order to shift the temperature of the particulate matter toward a lower resistivity value. However, this technique generally requires a large amount of power to produce the required temperature shifts.

Previous attempts to adjust the electrical characteristics of the passive electrode in order to reduce back corona and sparkover have generally used a collection electrode made of a resistive material having a non-critical resistance. These electrodes, termed "graded resistance" electrodes, inherently functioned as a current limiting series resistance, and they had only a minor effect in reducing sparkover in electrostatic precipitators. The resistance has the effect of producing a large voltage drop within the electrode as current increases at times of abnormal transient conditions thereby lowering the intensity of the electrostatic field across the electrode gap. Previously used "graded resistance" electrodes have generally been large planar slabs of somewhat conducting materials such as cement-asbestos, or of concrete with an imbedded grid of reinforcing steel to facilitate to a crude degree more uniform current collection. The approach simply was not sufficiently effective for broad commercial application. The graded resistance electrodes were not of a specified maintained design resistivity or uniformity of resistivity. In general their resistivity changed significantly with moisture, absorbed chemical content, and electric field in the material. They never were a satisfactory means of limiting sparking. The inadequacy of all electrostatic precipitator electrodes operating as simply current limiting devices is clearly evidenced by the fact that none are used in present-day commercial apparatus. (Resistors now under development with electrostatic precipitators are employed only to limit the fault current to a unit in which there is a sparkover, in order to minimize the momentary lowering of the voltage on all other units of the group supplied by a common rectifier.)

A form of current limiting resistance, also called a "graded resistance", is described in H. J. White, *Resistivity Problems in Electrostatic Precipitation,* Journal of the Air Pollution Control Association, 24, pages 336–37 (1974). In accordance with this technique a metal plate was coated with a carbon-impregnated plastic having a resistivity between $10^{10}$ and $10^{11}$ ohm-cm as determined by the degree of carbon loading. The description of this approach was never definitive as to the specific volume resistivity, material thickness, dielectric strength or homogeneity at, and close to, the anode surface which would allow the technique to be utilized with a variety of ionizer designs. Also, the article's description of the carbon-impregnated plastic composition of the coating suggests that the outer 0.25 mm of the coating need not be homogeneous to any specific value in order to effectively prevent spark formation and suppress back corona. Instead, the article appears to describe an attempt to insert an appreciable resistance in series with the discharge, with no engineered concept specifying critical design parameters. This is suggested by the statement contained therein that the concept "is by no means new, in that it originated in the 1920's during the early work on electrical precipitators."

In summary, the only mechanism applicable to "graded resistance" technology is that of inserting a series resistance in the discharge circuit in order to reduce the driving voltage thereby throttling total current flow.

Recently, a high intensity ionizer has been developed in which a unique electrode geometry produces a stable, high intensity corona discharge through which the particulate-laden gas passes. This ionizer which is described and claimed in U.S. Pat. No. 4,110,086 charges the particulate matter to a much higher level than is achievable with conventional ionizers utilizing, for example, wire-cylinder or wire-plate geometries. Although the collection efficiency of two-stage electrostatic precipitators can be greatly improved by employing this unique high intensity ionizer as a charging stage, back corona and sparkover has nevertheless been a problem, particularly with very high resistivity particulate matter, as the particulate matter builds up on a metal passive electrode.

In a low pressure gas electrical discharge, as in a flourescent light tube, the energy balances in the discharge is such as to produce operation with the current flowing with low density in a large-diameter column. But the physics of electrical discharges is such that with increase in pressure the discharge diameter decreases at such a rate that the current density increases as the square of the gas density. At atmospheric pressure and ordinary ambient temperatures all electrical discharges inherently contract into the narrowchannel high-current-density low-electric-field form termed an arc, which in transitory form is called a spark. This invention is a basic means for preventing the contraction of a corona discharge into an arc form.

With a negative corona discharge the gas in the near-vicinity of an electric field concentrating cathode is momentarily broken down, causing paths of intense ionization to propagate a small fraction of the distance to the anode. Electrons set free in the intense ionization processes drift toward the anode, usually attaching to molecules to form negative ions before arriving at the anode as a low-density (0.1–10 $\mu A/cm^2$) flow of current. The corona discharge is a rapid succession of non-completed discharges in the cathode-anode space, but current to the anode is, in the main, a steady uni-directional current.

In most applications of practical importance it is essential to operate corona discharges with as high intensities as possible without excessive back corona or sparkovers. A critical condition is reached rapidly because the current increases about as the square of the applied voltage. At the critical point there is a sudden local transition from a high-field low-current-density discharge to a low-field high-current-density discharge, i.e. from a glow-type to an arc-type of discharge.

SUMMARY OF THE INVENTION

It is an object of this invention to suppress back corona and prevent sparkover in an electrostatic precipitator particularly when the precipitator is employed to remove high resistivity particles from gases.

It is another object of the invention to determine the allowable electrical and mechanical properties of resistive anode coatings such as material resistivity, minimum coating thickness, and coating material uniformity in order to suppress back corona and prevent sparkover.

It is still another object of the invention to identify resistive materials having specific electrical properties, such as resistivity and dielectric strength, which are within a predetermined range for use as a resistive coating for a passive electrode.

These and other objects of the invention are accomplished by coating the anode of an electrostatic device such as the charging or collecting stage of a two-stage electrostatic precipitator, or single-stage electrostatic precipitator, with a resistive material in order to permit increase of the intensity of the device's electrostatic field at which the electrostatic device can operate without sparkover or excessive back corona.

The resistive material must have an outer "primary" layer facing the discharge electrode at least about 0.25 mm thick in which the material is substantially homogeneous and has a high dielectric strength. The total resistive material, including the primary layer, is preferably sufficiently thin to prevent more than about 15 percent of the applied voltage from being absorbed by the material. The minimum resistivity of the material in the primary layer is proportional to the square of the corona current flux. The resistive material resists deterioration in a corona environment, and is resistant to abrasion especially in applications where abrasive particulate matter is being charged.

BRIEF DESCRIPTION OF THE DRAWINGS

FIG. 14 is a broken isometric view illustrating an ionizer of the wire-cylinder geometry having a resistive coated anode;

FIG. 15 is a broken isometric view illustrating an ionizer of the wire-plate geometry having a resistive coated anode; and FIG. 16 is an isometric view showing another embodiment of a high intensity ionizer having a resistive coated anode.

DETAILED DESCRIPTION OF THE PREFERRED EMBODIMENT

Figure 1:
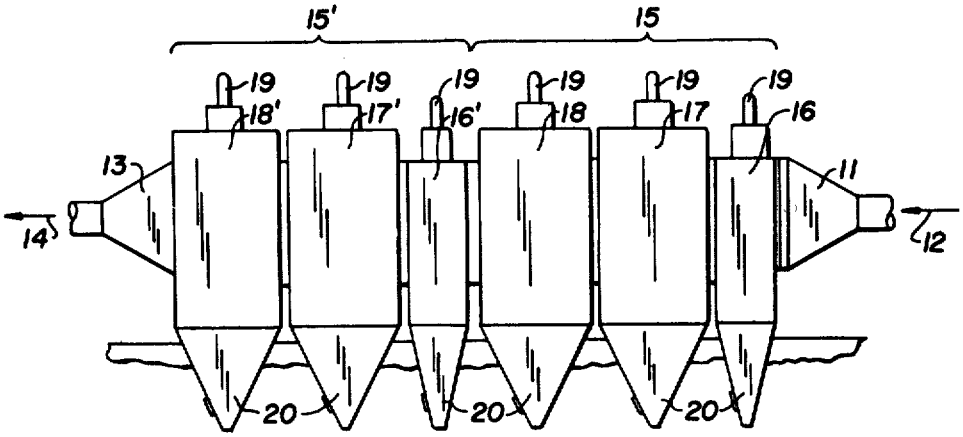
FIG. 1 is a schematic side elevational view illustrating a multi-stage precipitator employing a charging ionizer having a resistive anode of the present invention.

Turning now to the drawings, FIG. 1 shows in schematic side elevational view a two-stage electrostatic precipitator system incorporating the invention. As seen in this Figure, the precipitator system includes a gas inlet 11 into which gases to be cleaned are directed as indicated by arrow 12, a gas outlet 13 from which cleaned gases are supplied to appropriate downstream apparatus, e.g. an atmospheric discharge duct, as indicated by arrow 14, and a cascaded pair of ionizer-precipitator units generally designated by reference numerals 15, 15'. Each ionizer-precipitator unit 15, 15' includes an ionizer stage 16 (16') and a pair of conventional electrostatic precipitators 17, 18, (17', 18'). Each ionizer stage 16, 16' and precipitator stage 17, 17', 18, 18' is provided with a high voltage input cable connector 19 coupled to a suitable source of high voltage as described more fully below with reference to FIG. 6, and a collecting bin portion 20 for collecting particulate matter precipitated from the gas as the latter flows through units 15, 15'.

In operation, gases containing particulate matter enter the FIG. 1 apparatus via inlet 11 and pass through the first ionizer stage 16 in which the particles in the gas are electrostatically charged. The gas bearing the electrostatically charged particles next flows into successive precipitator stage 17, 18 in each of which the charged particles are deflected out of the flow path of the gas under the influence of an electrical field established across the flow path, the particles being deposited in the bin portions 20 of the precipitator stages 17, 18. The gas exiting from precipitator 18 is passed through ionizer stage 16', and precipitator stages 17', 18', to provide additional cleaning therefor, and the cleansed gases emerging from precipitator stage 18' are conducted via gas outlet 13 to appropriate downstream apparatus.

Figure 2:
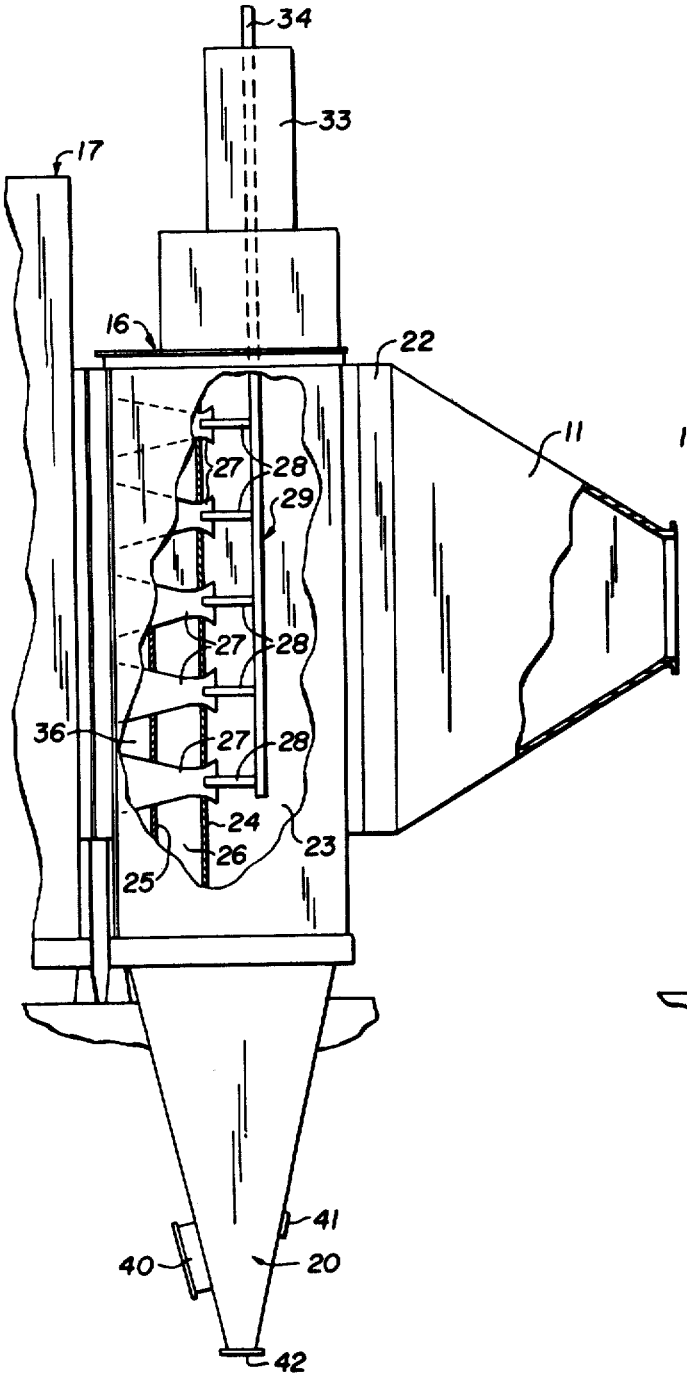
FIG. 2 is an enlarged side view of one ionizer stage of the apparatus of FIG. 1 partially broken away to show the ionizer array.
Figure 3:
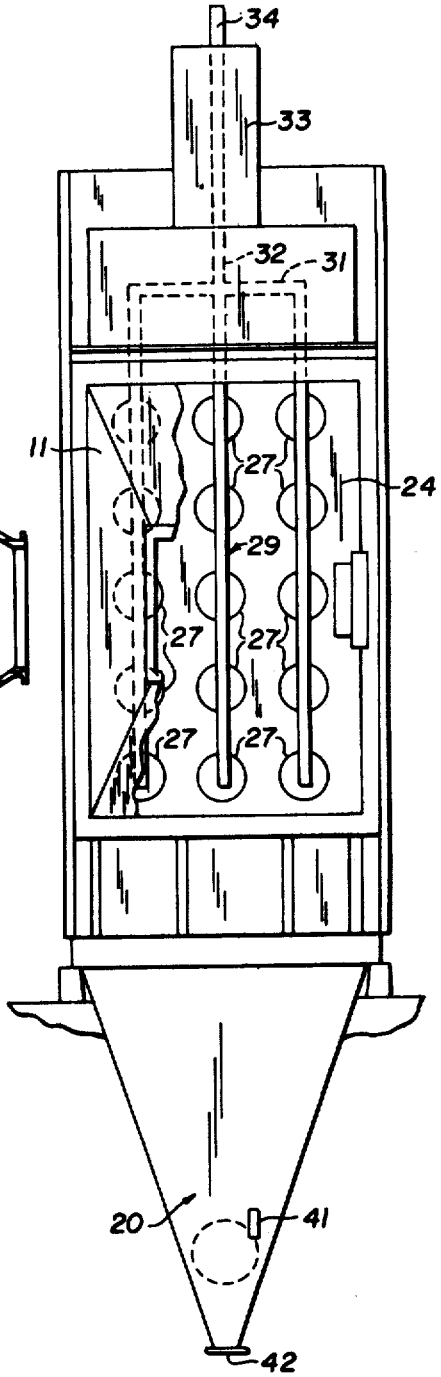
FIG. 3 is an end elevational view of the ionizer stage of FIG. 2 with the inlet partially broken away to show the ionizer array.

FIGS. 2 and 3 illustrate the gas inlet 11 and the first ionizer stage 16 with more particularlity. As seen in these Figures, gas inlet 11 comprises a hollow conduit of trapezoidal or other suitable geometric configuration which is coupled at the downstream side to a gas distributor portion 22. Distributor portion 22 is coupled to an entry chamber 23 formed within the housing of ionizing unit 16 by the side and bottom walls thereof and a vertically arranged bulkhead 24. Bulkhead 24 and a second vertically arranged bulkhead 25 define with the side, top and bottom walls of ionizer stage 16 a pressure manifold 26 for a purpose to be described.

Positioned within ionizer stage 16 in a regular array are a plurality of venturi diffusers 27 and associated central electrode support members 28 each projecting into the upstream end of the associated venturi 27 and substantially coaxially therewith. Each member 28 is coupled to a bus bar network genrally designated by reference numeral 29 and consisting of three vertically arranged parallel bus bars interconnected at the upper ends thereof by a common bus bar element 31, the element 31 being connected to a single bus bar element 32 extending from the interior of stage 16 to an external conventional high voltage connector shroud 33 to which a high voltage is supplied from a suitable power source (not shown) via high voltage connector 34. The downstream end or outlet of each venturi 27 is coupled to an exit chamber 36 which is in turn coupled to the inlet of electrostatic precipitator stage 17.

Storage bin 20 is provided with a removable door 40 for purposes of inspection and cleaning, and a vibrator bracket 41 for permitting the use of an optional conventional vibrator to assist in settling any particulate matter collecting in bin 20 towards the bottom edge 42 thereof. Bottom edge 42 is provided with suitable apertures (not shown) for enabling the particulate matter to be removed from the bin 20 in a conventional manner. Bins 20 of the remaining system elements 16', 17, 17', 18 and 18' are configured in a substantially identical manner.

Each venturi element 27 and associated coaxial member 28 generally comprises an electrode pair for generating a high intensity electrostatic field across the path of gas flow through the ionizer state 16. For this purpose, an electrode (described below) is carried by each member 28 and is coupled to a source of relatively high negative potential, via bus bar network 29 while each venturi conduit 27 is coupled via the framework of the structure to ground potential. Thus each venturi 27 serves an anode and each member 28 serves as a cathode support.

In operation, with the high voltage applied between the cathode and anode, particles suspended in any gas flowing through the ionizer stage 16 are electrostatically charged when passing through the throat of venturi 27. In order to ensure that substantially all charged particles remain suspended in the flowing gas until arriving at the downstream precipitator 17 or 18, and do not adhere to the ground potential anode surface, the electrode configuration shown in FIGS. 4 and 5 may be employed.

Figure 4:
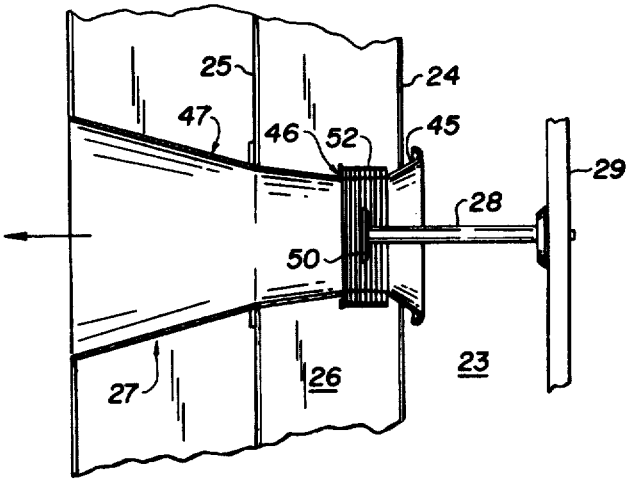
FIG. 4 is an enlarged partial sectional view of a single ionizer venturi illustrating the electrode arrangement.

With reference to FIG. 4, each venturi element 27 is formed with an inwardly tapering conical inlet section 45, a generally cylindrical central section or throat 46 and an outwardly tapering conical outlet portion 47. The cathode includes a planar electrode such as a disc 50 which may have a curved peripheral edge which projects outwardly from the outer surface of member 28. Disc 50 is mounted substantially coaxially in the throat of venturi 27 and provides a highly constricted high intensity electrostatic field in the form of a corona discharge between the curved periphery of disc 50 and the surrounding anode surface 52 when a high potential is applied. The surface of the throat 46 may either be smooth or it may be formed with a plurality of vanes to allow cleaning air to be injected through the throat 46 as illustrated in FIG. 4.

Figure 5:
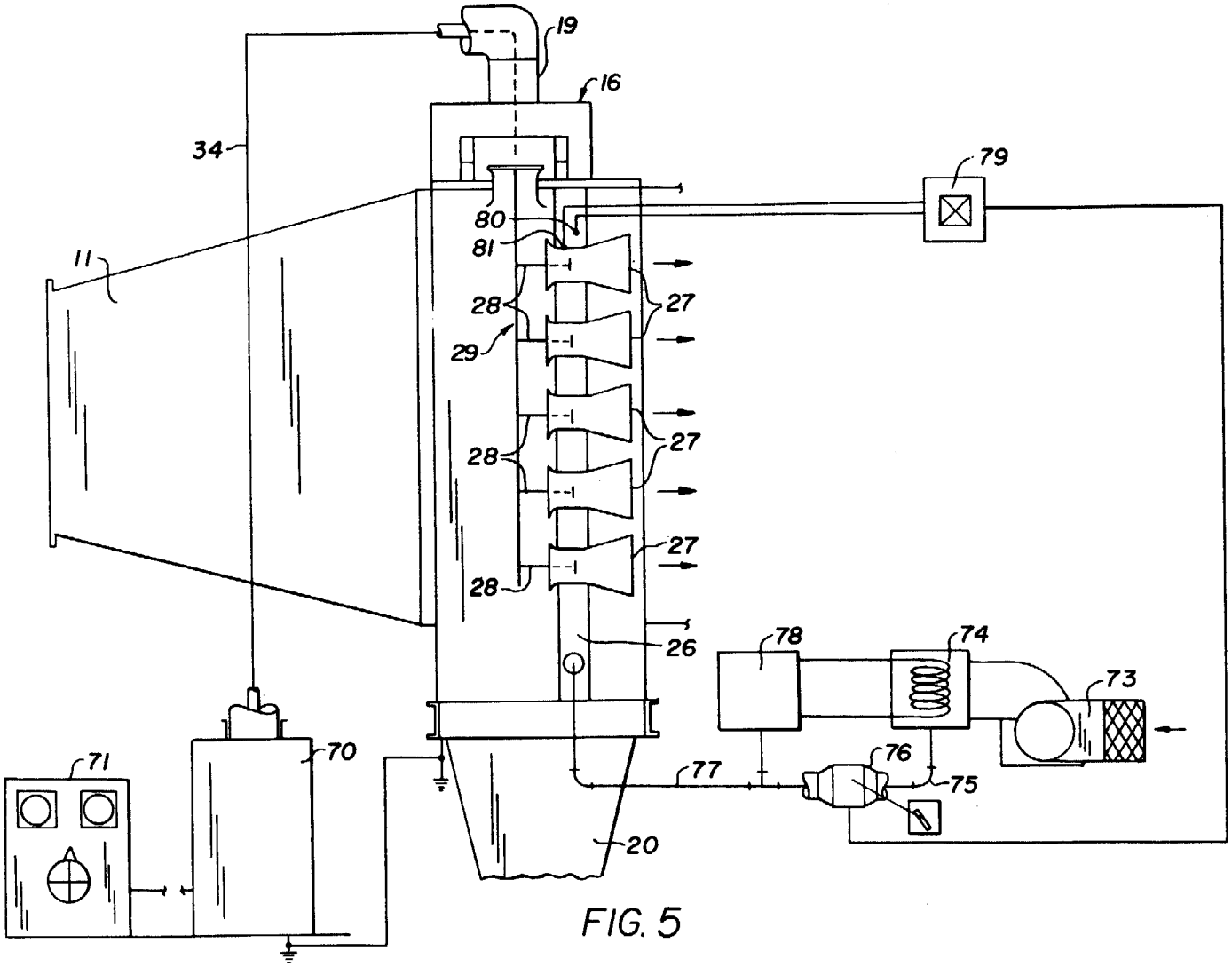
FIG. 5 is a schematic system diagram showing the control elements for an ionizer stage.

FIG. 5 schematically illustrates the electrical power connections and clean gas injection control system of ionizer stage 16. High voltage is supplied to cathode bus network 29 via high voltage cable 34 from a transformer rectifier set 70 coupled to a control unit 71, both latter elements being of conventional design. Clean gas is supplied to manifold chamber 26 from a blower 73 via a heater 74 conduit 75, a controlled damper 76 and a conduit 77. Heater 74 is connected to a temperature controller unit 78 for maintaining the temperature of the clean gas supplied to manifold chamber 26 within a desired temperature range. A differential pressure sensor 79 having a pair of pressure transducers 80, 81 provide a feedback signal to controlled damper 76 in order to provide pressure regulation for the clean air within manifold chamber 26. Elements 73–81 are all conventional units, the structure of which is well within the ordinary skill of the art.

As noted above, a major problem encountered with electrostatic devices, particularly when employed to charge particulate matter of high resistivity such as fly ash from coal fired boilers using low sulphur coal as a fuel, has been the incidence of sparkover and back corona which is generally the limiting factor on increasing the intensity of the electrostatic field. Back corona and sparkover occur when the intensity of the electrostatic field within the particulate matter on the passive electrode exceeds the dielectric strength of the particulate material. For example, the dielectric strength of fly ash produced by burning low sulphur coal is generally between 10 kv/cm. and 20 kv/cm. When the dielectric strength is exceeded the energy stored in the capacitance of the dielectric in the local region is discharged in an arc form of discharge in a filamentary path. The gas blast produced by the arc can cause the formation of only a narrow filamentary hole, or a large crater, depending on the energy dissipated. Emission of ionizing ultra-violet radiation and emission of positive ions form the arc into the closely adjacent part of the ionizer field increases its conductivity. The end result is either that (1) only a glow-type back discharge is established in the crater, or (2) a spark across the entire gap is triggered.

The field in the layer of particulate matter is given by the formula:

$$E = J\rho \qquad \text{(FORMULA 1)}$$

Where J is the density of the current through the particulate layer, and $\rho$ is the volume resistivity of the material. The current density J for ionizers is generally on the order of $1\times10^{-8}$ A/cm and $2\times10^{-6}$ A/cm. Consequently, for particulate matter having a dielectric strength of 10 kv/cm back corona and sparking is not a problem until volume resistivities exceed between $10^{12}$ ohm-cm and $5\times10^{9}$ ohm-cm, respectively.

Back corona compromises the operation of the ionizer since positive ions rejected from the arc breakdowns in the particulate layer arc injected into the interelectrode region and the positive ions discharge the negatively charged particulates, thereby defeating the purpose of the charging stage.

In accordance with the present invention, the passive electrode of an electrostatic device is coated with a resistive material having a high dielectric strength. The term "electrostatic device" as used herein refers to either the charging stage or the collecting stage of a two-stage electrostatic precipitator, or a single-stage electrostatic precipitator employing a unitary charging and collecting stage. The passive electrode is generally an anode since the effects of back corona and sparkover are more serious with negative corona in which the cathode is the corona emitting electrode. In the negative corona, most of the current is carried by negative ions which originate from electrons liberated from the cathode or discharge electrode surface by positive ion bombardment. The positive ions in turn are generated in the high field region near the cathode by electron ionization of the gas molecules. Back corona, which has such is disruptive effect effect on the negative corona, has only a small effect on positive corona. Consequently, resistive material coating on the passive electrode is much more useful in negative corona than in positive corona devices. Thus the term "passive electrode", while generally used synonymously with "anode" in negative corona electrostatic devices, is intended to include the cathode of a positive corona electrostatic device.

Figure 6:
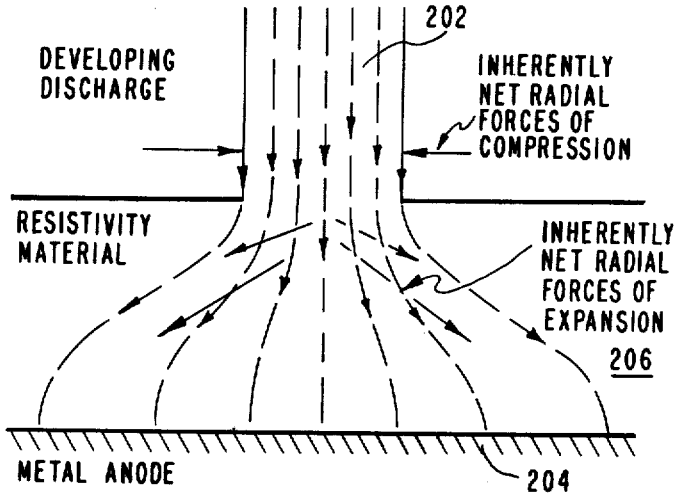
FIG. 6 is a schematic illustrating the nature of the forces acting on a developing discharge before and after it enters the resistive coating.

The cardinal statement relating to this invention is that in order to form an arc the high-current discharge will concentrate to a very small diameter at its anode terminal if the anode is of metal or other material of good conductivity. These sparks can thus be prevented by preventing concentration of the terminal spot on the anode. In order to maintain the energy balance in the developing discharge in the gas at an anode, the net radial forces are inherently forces of compression so that the discharge tends to contract into an arc. However, as illustrated in FIG. 6, by coating the anode 204 with a resistive material 206 an outwardly radial force is created in the resistive material since current flowing through a resistive material follows the path of least resistance. This expansive force opposes the contractive force in the developing discharge 202 to prevent concentration. Consequently, the discharge cannot convert from a relatively low-current-density, high-electric-field form, to the high-current-density, relatively low-electric-field form associated with sparkover. The design value of the resistivity is high enough that at the anode terminal spot the forces of expansion just below the anode surface exceed the forces of compression in the gas just above it.

Figure 7:
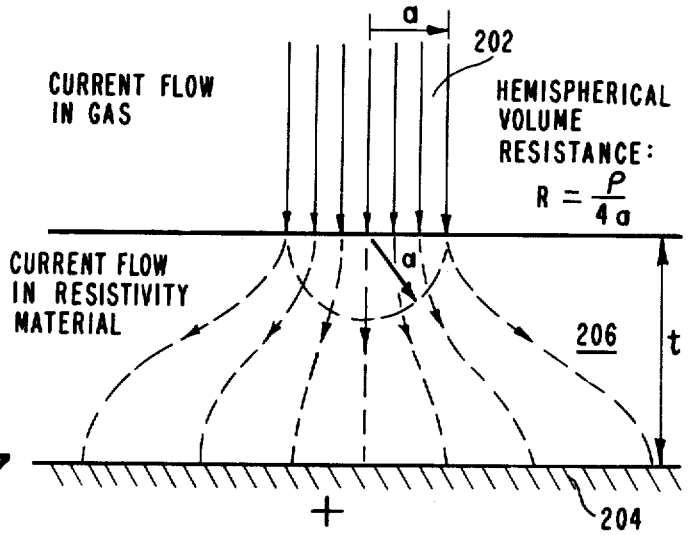
FIG. 7 is a schematic illustrating the current flow pattern of a developing discharge before and after it enters the resistive coating.

The uniqueness of the invention is made apparent in considering the minimum allowable thickness of the resistive layer. Referring to FIG. 7, upon entering the resistive layer 206 the current flow inherently spreads out in order to obtain the lowest voltage drop per unit volume. Classical mathematical analysis gives the resistance to current flow of the hemispherical volume 208 underneath the discharge anode spot to be very close to the total resistance to current flow through the whole layer if the thickness of the resistive layer 206 is at least four times the radius of the hemisphere 208. The minimum thickness of the resistance layer 206 is thus quite directly related to the minimum diameter the anode spot can be allowed to take without being dangerously close to the critical diameter at which a glow-to-arc transition hence a spark, can occur.

Accurate assessment of this critical diameter by analysis is far beyond present day capability. Highest speed photographic studies do not suffice for accurate assessment but do provide rough guidance. From a study of anode spot development photographs obtained by J. M. Sommerville and C. T. Granger, *Discharge and Plasma Physics*, Hayden, Armidale Press, N.S.W., Australia, 1963, pp. 406–07, it was estimated that the anode spot radius may contract to perhaps as small as 0.03 millimeter without forming a spark. A resistive layer thickness of four radii would be 0.12 millimeter. a very practical layer thickness of only 0.25 millimeter, or 0.010 inch would then easily meet the requirement of the thickness being large compared to the minimum allowable spot radius.

Figure 8:
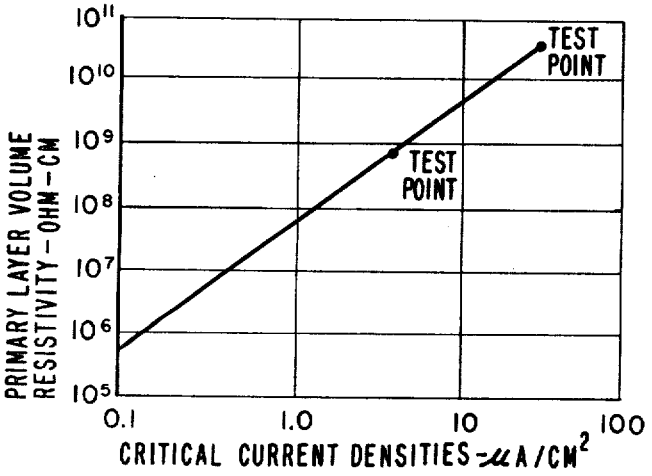
FIG. 8 is a graph illustrating the relationship between the density of the current arriving at the anode of an electrostatic precipitator and the volume resistivity needed to prevent the discharge from concentrating.

The tendency for any electrical discharge to constrict increases strongly with the magnitude of the current. To provide sufficient counter-forces of expansion to prevent spark formation when the normal current flow tries to constrict, the resistivity must be appropriately high. The normal flow of electrons and ions in the flow of corona current can be triggered into a more intense and concentrated flow, or discharge, by a number of events in the discharge space, all of which depend on probabilities. The practical result is that with higher normal anode collection current densities, and higher attendant electric field gradients, the probability of discharge constriction increases rapidly with the normal corona current density. Therefore, the resistivity of the resistive anode required to prevent constriction and sparking also increases rapidly. In tests on resistive anodes for electrostatic precipitator ionizers, approximate values of necessary minimum resistivities were determined as a function of the critical magnitudes of the normal collected current density. The resistivity increases as the square of the current, or closely so, as illustrated in FIG. 8. More specifically, FIG. 8 empirically shows that the minimum resistivity is given by the formula:

$$\rho_{min} = \left[ 7 \times 10^7 \frac{\text{(ohm-cm) cm}^4}{(\mu A)^2} \right] J^2$$

where $\rho_{min}$ is the minimum volume resistivity in ohm-cm and J is the corona current density in microamps/cm$^2$. In these tests the triggering actions were those produced by back corona in a thin very high resistivity ($\approx 10^{12}$ ohm-cm) fly ash coating on the resistive layer.

The voltage drop $\Delta$ V across the resistive coating is in accordance with the following formula:

$$V = J\rho t \qquad \text{(FORMULA 2)}$$

where t is the thickness of the resistive coating, and $\rho$ is the volume resistivity of the coating and J is the current density. The voltage drop $\Delta$ V across all of the anode material should be preferably less than 15 percent of the applied voltage.

The minimum resistivity of the primery layer of resistive material is principally a function of the current density at the surface of the primary layer facing the discharge electrode, and is determined in accordance with the relationship shown in FIG. 8. After the resistivity of the resistive material is selected, the maximum thickness of the coating may be calculated for maintaining a particular limiting voltage drop across the resistive coating of preferably less than 15%, and more preferably less than 5%, of the applied voltage. As a "best determinable value" the minimum thickness of the material is taken to be 0.25 mm (0.01 inch), as explained hereinafter. Thus, if $2 \times 10^{10}$ ohm-cm is selected as the working resistivity of the resistive coating of an ionizer having a current density of $2 \times 10^{-6}$ A/cm$^2$, and 75 kv is applied between the anode and cathode of the ionizer, the thickness of the resistive coating which would absorb 15 percent of the voltage is calculated by formula 2 as about 0.28 cm. It should be noted, however, that the resistivity of the coating is inversely proportional to temperature so that temperature fluctuations must be accounted for when selecting a working resistivity value. In a material of the design resistivity at the working temperature, the highest possible dielectric strength is applicated since it imposes an upper limit on the allowable working current density.

The thin resistive anode layer referred to above is designated as the primary layer; it is used in conjunction with a structurally supportive layer. Since, as taught above, all the resistive necessary to prevent spark formation will exist in a layer less than 0.25 mm (0.010 inch) thick, the resistivity of the supportive layer may be of any value. It may be metal, it may be the identical value (and material, if desired) of the primary resistive layer, or it may be any intermediate value. A practical consideration is to avoid an unnecessarily large voltage drop and power loss in the supportive layer as discussed above.

In considering the prevention of the development of a spark at a particular location, it is not the general resistivity of the layer but the volume resistivity in only the hemispherical volume under the anode discharge spot that is crucial, as explained above. If in only this hemispherical volume the volume resistivity were substantially lower than the specified minimum there would be sparking. Therefore, a statement as to uniformity in the material of the primary layer must be imposed. The resistivity shall not be substantially less than the design value in any micro-volume which is larger in any dimension than about 6 micro-meters, which is about one-fifth of the estimated minimum diameter which the discharge terminal spot may have without danger of sparking. In other words the 0.25 millimeter layer closest to the discharge electrode must be devoid of volumes with a dimension larger than 0.006 millimeters having a volume resistivity substantially lower than the volume resistivity needed to prevent concentration of corona current. Sparking due to small scale low-resistance non-unformities has been definitely identified during the development work. The need for resistivity uniformity in micro-volumes is a new disclosure, has been verified in tests, and probably prevented success in the efforts of others attempting to prevent sparking with thin resistive coatings.

The electrical functioning of the thin primary resistive anode layer is not dependent upon, nor impaired by, the electrical properties of the supportive secondary layer upon which is placed in intimate contact and bond. The supportive layer may be metal, or any physically and chemically acceptable non-metal of non-critical and unspecified resistivity. Obviously, the resistance of the supportive layer should not be so high as to cause excessive voltage drops and power loss.

Important embodiments of the invention use the concept of having the same material serving for the primary layer and for the supportive secondary layer, making a monolithic anode structure. It whould be deceptive to assume that the electrical operation has now become that of a "graded resistance"; the "primary layer" volume is still of a design value, preferably of the lowest suitable resistivity, and the uniformity of resistivity requirement in it must be met.

Figure 9:
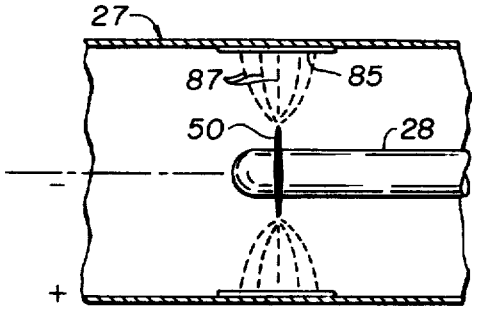
FIG. 9 is a schematic diagram illustrating the current flow pattern in an ionizer having a layer of resistive material coating a simple cylindrical anode.
Figure 10:
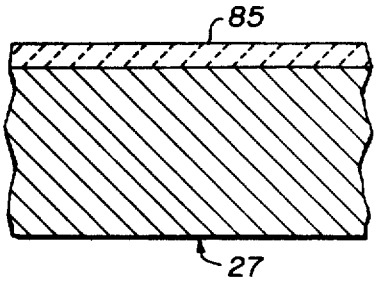
FIG. 10 is an enlarged view of a portion of the anode of FIG. 9.

The inventive resistive coating has been described as a technique for suppressing back corona and sparkover, but it also can be looking upon as a means which allows the intensity of the electrostatic field in a given electrostatic device to be increased without producing excessive back corona and sparkover. As illustrated in FIG. 9, the problems of sparkover and back corona are reduced according to the invention by providing a layer of resistive material 85 on the inner surface of the anode 27 in the region adjacent the planar electrode 50 in which the electrostatic field therebetween represented by dotted lines 87 is concentrated. The physical and electrical properties of the resistive material 85 are calculated in accordance with the above described procedure.

Figure 11:
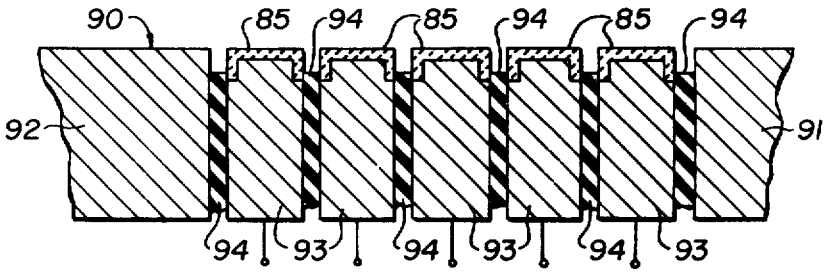
FIGS. 11–13 illustrate alternate embodiments of the invention.

The simple annular band shown in FIG. 9 for resistive layer 85 is only one of several possible configurations envisioned. For example, with reference to FIG. 11 an anode 90 is shown which comprises inlet and outlet wall sections 91, 92 fabricated from an electrically conductive material, a plurality of conductive anode segments 93 also fabricated from a good electrically conductive material and electrically insulative spacers 94 interposed between adjacent conductive elements 91–93 for providing electrical isolation therebetween. A layer of resistive material 85 is provided on the inner surface of each of the anode segments 93. Each of the conductive segments 93 can be also provided with a suitable terminal adapted to be coupled to independent high voltage supplies (not shown) in order to permit electrical field shaping by regulation of the individual voltage supplies.

Figure 12:
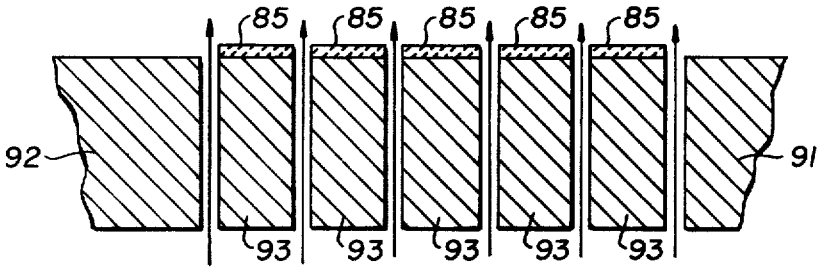

FIG. 12 shows an alternate embodiment of the invention in which anode segments 93 are mutually spaced to provide air passages therebetween for a similar purpose to that described above with reference to FIGS. 4 and 5, with each anode segment 93 being provided with a layer of resistive material 85 on the inner surface thereof.

Figure 13:
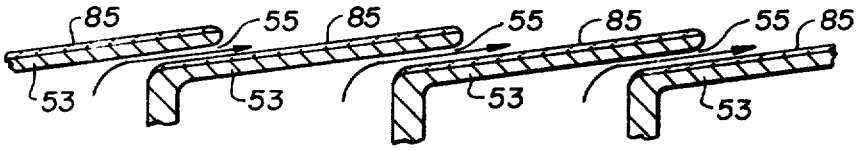

FIG. 13 illustrates still another embodiment of the invention in which the individual conical segmental vanes 53 are each provided with a layer of resistive material 85 along the inner surface thereof.

The collection efficiency of two-stage electrostatic precipitators employing other types of particle charging ionizers as well as single-stage precipitators may also be improved in accordance with this invention. With refernce to FIG. 14, a conventional, relatively low intensity electrostatic device of the wire-cylinder geometry includes a wire discharge electrode 100 suspended from a feed-through insulator 102 secured to a precipitator shell 104. The discharge electrode 100 is concentrically mounted with a tubular passive electrode 106 which also forms a duct for the particle-laden gases. A weight 108 is suspended from the discharge electrode 100 to maintain the position of the electrode 100 constant as gases flow through the passive electrode 106. A transformer rectifier set of conventional variety 110 is connected between the discharge electrode 100 and the passive electrode 106. In operation the particle-laden gas enters the passive electrode 106 through an inlet duct 112 and exits through an outlet duct 114 after passing through the full length of the electrostatic field extending between the discharge electrode 100 and passive electrode 106. The electrostatic device may be used as either the charging stage or the collecting stage of a two-stage electrostatic precipitator depending upon such physical and electrical design parameters as electrode size, field intensity and gas flow rate. The device may also be used as a single-stage electrostatic precipitator. The voltage between the discharge electrode 100 and the passive electrode 106 may be increased without causing excessive back corona and sparkover beyond a value heretofore possible by coating the inside surface of the passive electrode 106 with a resistive material calculated in accordance with the above described technique. Consequently, the capacity and/or charging efficiency of electrostatic precipitators employing wire-cylinder devices as illustrated in FIG. 14 can be vastly improved in accordance with this invention.

A conventional electrostatic precipitator of the wire-plate geometry is illustrated in FIG. 15. These conventional wire-plate devices utilize several spaced apart, wire discharge electrodes 120 suspended from a conductive bus bar 122 and supporting respective stabilizing weights 124. The discharge electrodes 120 are positioned between parallel plates 126 generally having deflector members 128 extending along the plates 126 transverse to the direction of gas flow through the ionizer. A relatively high voltage is maintained between the discharge electrodes 120 and plates 126 by a conventional transformer rectifier set (not shown). As with the conventional wire-cylinder device of FIG. 14, the collection efficiency and/or capacity of electrostatic precipitators employing conventional wire-plate devices may be greatly increased by coating the plates 126 with a layer of resistive material having electrical and physical properties calculated in accordance with the above described procedure.

A high intensity ionizer somewhat similar to the ionizer illustrated in FIG. 9 and having a resistive anode is illustrated in FiG. 16. The ionizer utilizes a planar discharge electrode 130 mounted at the end of a support member 28 which places the discharge electrode 130 coaxial with a glass or other suitable dielectric tube 134. The outer surface of the glass tube 134 adjacent the discharge electrode 130 is coated with a conductive material 136, which could be tin oxide. A relatively high voltage is then placed between the discharge electrode 130 and conductive coating 136 by a conventional transformer rectifier 138 which is connected to the discharge electrode 130 through a conductor 132 in the support 28. The conductive layer 136 forms the anode of the ionizer, and the physical and electrical properties of the uniform dielectric glass tube 134 are selected so that the tube 134 constitutes both the primary resistive coating and the physically supportive layer with the conductive layer 136 serving as a good conductivity current collector.

A variety of resistive materials may be used to fabricate resistive anodes in accordance with this invention. The resistive material may comprise an epoxy resin having the required homogeneity volume resistivity and dielectric strength. However, epoxy resins deteriorate in a corona environment, and they may be sufficiently resistive to abrasive wear to be advantageously employed. Aluminum-oxide may be provided with a suitable dopant oxide and/or metal to obtain specific required resistivities. Candidate materials include:

I. ORGANIC MATERIALS HAVING A DIELECTRIC STRENGTH OF AT LEAST 50 KV/CM;

a. STYCAST 2762FF epoxy sold by Emerson Cumings Stycast—resistivities are suitable for low intensity ionizers.

b. STYCAST 2762 epoxy sold by Emerson Cumings Stycast—resistivities are suitable for low intensity ionizers. Can be molded in place on anodes.

c. Type C-26 epoxy sold by Emerson Cumings—resistivities are suitable for both high and low intensity ionizers. May be applied to anodes in thin coats by spraying or painting.

II. INORGANIC MATERIALS HAVING A DIELECTRIC STRENGTH OF AT LEAST 80 KV/CM a. Type LA-2-500 aluminum oxide coating sold by Union Carbide—resistivities are suitable for low intensity ionizers or high intensity ionizers above 550° F. The volume resistivity is $10^{12}$ ohm-cm at 300° F. and $10^{10}$ ohm/cm at 550° F. The coating is applied with a specially developed plasma gun. Since the material was developed as an anti-wear coating its resistance to abrasion is excellent.

b. Porcelainized steel having a volume resistivity range between $10^{12}$ ohm-cm and $2\times10^{11}$ ohm-cm at 300° F. Thicknesses range between 0.03 cm to 0.05 cm.

c. Pyrex pipe 7740 sold by Corning Glass Company. Resistivities are suitable for either high or low intensity ionizers since the resistivity is about $10^{10}$ at 300° F. Available in ⅛ to ¼ inch thick tubes. This material can be advantageously used in the embodiment illustrated in FIG. 16.

d. Pyroceram sold by Corning Glass Company:

1. Type 9606—resistivities are proper for low intensity ionizers or high intensity ionizers at temperatures above 500° F. Resistivity is $5\times10^{10}$ ohm-cm at 550° F. and about $5\times10^{11}$ ohm-cm at 300° F.

2. Type 9608—resistivities are proper for both high and low intensity ionizers since the resistivity is $3\times10^{9}$ ohm-cm at 300° F.

e. Soda-Lime glass sold by Corning Glass Company. Volume resistivity is $2\times10^{8}$ ohm-cm at 300° F.

f. VYCOR glass sold by Corning Glass Company. Resistivities are suitable for low intensity ionizers and high intensity ionizers at very high temperatures. Resistivity is $10^{12}$ ohm-cm at 300° F.

The inventive resistive anode can thus be used in a variety of ionizers in order to improve the capacity and/or charging efficiency of two-stage electrostatic precipitators.

The resistive anode has been described herein as forming part of an electrostatic precipitator for removing fly ash from coal fired power plants. However, the resistive anode may also be advantageously employed in other applications including electrostatic devices used outside the power generating field as well as in electrostatic precipitators for power plants fired by such fossil fuels as oil and mixtures of high-sulphur and low-sulphur coal.

I claim:

1. In an apparatus having a discharge electrode, a passive electrode spaced apart from said discharge electrode by an electrode gap, power supply means connected between said discharge and passive electrodes for applying a voltage therebetween, said applied voltage being of sufficient magnitude to effect a corona current producing electrostatic field between said discharge and passive electrodes, means for preventing sparkover and suppressing back corona within said electrode gap comprising a layer of material on said passive electrode between said discharge electrode and said passive electrode means having a thickness of at least 0.25 mm, the 0.25 mm of said material closest to said discharge electrode being devoid of volumes with a dimension larger than 0.006 mm having a volume resistivity substantially lower than the volume resistivity needed to prevent concentration of said corona current such that said 0.25 mm of material closest to said discharge electrode is a substantially homogeneous primary layer having sufficient volume resistivity to suppress back corona and prevent sparkover.

2. The apparatus of claim 1 wherein the minimum volume resistivity of the material in said primary layer is approximately proportional to the square of the corona current flux at said passive electrode.

3. The apparatus of claim 2 wherein the approximate minimum volume resistivity is given by the formula:

$$\rho_{min} = \left[ 7 \times 10^{7} \frac{(\text{ohm-cm})\ \text{cm}^4}{(\mu A)^2} \right] J^2$$

where $\rho$ m is the volume resistivity in ohm-cm and J is the corona current density in micro-amps/cm$^2$.

4. The apparatus of claim 1 wherein the thickness of said material is less than 15% of the ratio of said applied voltage to the intensity of the field through said material.

5. The apparatus of claim 4 wherein the thickness of said material is in the range from about 5% to about 10% of the ratio of said applied voltage to the intensity of the field through said material.

6. The apparatus of claim 1 wherein the entire layer of said material is devoid of volumes with a dimension larger than 0.006 mm having a volume resistivity substantially lower than the volume resistivity needed to prevent concentration of said corona current.

7. The apparatus of claim 1 wherein said primary layer of resistive material is an organic compound having a dielectric strength greater than 50 kv/cm.

8. The apparatus of claim 7 wherein said organic compound is an organic resin.

9. The apparatus of claim 8 wherein said organic resin is epoxy resin.

10. The apparatus of claim 1 wherein said primary layer of resistive material is an inorganic compound having a dielectric strength greater than 80 kv/cm.

11. The apparatus of claim 10 wherein said inorganic compound is a metal oxide.

12. The apparatus of claim 11 wherein said metal oxide is aluminum oxide.

13. The apparatus of claim 12 wherein said aluminum oxide has a volume resistivity of $10^{12}$ ohm-cm at 300° F. and a resistivity of $5\times10^{10}$ ohm-cm at 550° F.

14. The apparatus of claim 10 wherein said inorganic compound is a glass-ceramic having a volume resistivity in the range from about $3\times10^{9}$ ohm-cm to about $10^{12}$ ohm-cm at 300° F.

15. The apparatus of claim 10 wherein said inorganic compound is a ceramic metal.

16. The apparatus of claim 10 wherein said primary layer of material is a ceramic having a volume resistivity in the range from about $10^{11}$ ohm-cm to about $10^{12}$ ohm-cm at 300° F.

17. The apparatus of claim 10 wherein said inorganic compound is a glass having a volume resistivity in the range from about $10^{9}$ ohm-cm to about $10^{12}$ ohm-cm at 300° F.

18. The apparatus of claim 1 wherein said passive electrode includes a plurality of mutually spaced electrically conductive sections electrically isolated from each other, and wherein said resistive material covers the surface of each section facing toward said discharge electrode.

19. The apparatus of claim 18 further including a plurality of insulative spacers positioned between said electrically conductive sections.

20. The apparatus of claim 18 wherein said sections are spaced apart from each other to provide a plurality of interstitial fluid passages therebetween.

21. In a high intensity ionizer having a tubular passive electrode adapted to conduct particulate-laden gas therethrough, a planar discharge electrode concentrically mounted within said passive electrode and separated therefrom by an electrode gap, power supply means connected between said discharge and passive electrodes for applying a voltage therebetween, said applied voltage being of sufficient magnitude to effect a corona current producing electrostatic field between said discharge and passive electrodes, means for preventing sparkover and suppressing back corona within said electrode gap comprising a layer of material having a thickness of at least 0.25 mm on the inside surface of said passive electrode between said passive electrode and said discharge electrode, the 0.25 mm of said material closest to said discharge electrode being devoid of volumes with a dimension larger than 0.006 mm having a volume resistivity substantially lower than the volume resistivity needed to prevent concentration of said corona current such that said 0.25 mm layer of said material closest to said discharge electrode is a substantially homogeneous primary layer having sufficient volume resistivity to suppress back corona and prevent sparkover.

22. The apparatus of claim 21 wherein the minimum volume resistivity of the material in said primary layer is approximately proportional to the square of the corona current flux at said passive electrode.

23. The apparatus of claim 22 wherein the approximately minimum volume resistivity is given by the formula:

$$\rho_{min} = \left[ 7 \times 10^{7} \frac{(\text{ohm-cm})\ \text{cm}^{4}}{(\mu A)^{2}} \right] J^{2}$$

where $\rho m$ is the volume resistivity in ohm-cm and J is the corona current flux in micro-amps/cm$^2$.

24. The high intentisy ionizer of claim 21 wherein the thickness of said material is less than 15% of the ratio of said applied voltage to the intensity of the field through said material.

25. The high intensity ionizer of claim 21 wherein the thickness of said coating is in the range from about 5% to about 10% of the ratio of said applied voltage to the intensity of the field through said material.

26. The apparatus of claim 21 wherein the entire layer of said material is devoid of volumes with a dimension larger than 0.006 mm having a volume resistivity lower than the volume resistivity needed to prevent concentration of said corona current.

27. The high intensity ionizer of claim 21 wherein the dielectric strength of said primary layer of material is greater than about 100 kv/cm.

28. The apparatus of claim 21 wherein said primary layer of resistive material is an organic compound having a dielectric strength greater than 50 kv/cm.

29. The apparatus of claim 28 wherein said organic compound is an organic resin.

30. The apparatus of claim 29 wherein said organic resin is epoxy resin.

31. The apparatus of claim 21 wherein said primary layers of resistive material is an inorganic compound having a dielectric strength greater than 80 kv/cm.

32. The apparatus of claim 31 wherein said inorganic compound is a metal oxide.

33. The apparatus of claim 32 wherein said metal oxide is aluminum oxide.

34. The apparatus of claim 33 wherein said aluminum oxide has a volume resistivity of $10^{12}$ ohm-cm at 300° F. and a resistivity of $5\times10^{10}$ ohm-cm at 550° F.

35. The apparatus of claim 31 wherein said inorganic compound is a glass-ceramic having a volume resistivity in the range from about $3\times10^{9}$ ohm-cm to about $10^{12}$ ohm-cm at 300° F.

36. The apparatus of claim 31 wherein said inorganic compound is a ceramic metal.

37. The apparatus of claim 31 wherein said material is a ceramic having a volume resistivity in the range from about $10^{11}$ ohm-cm to about $10^{12}$ ohm-cm at 300° F.

38. The apparatus of claim 31 wherein said inorganic compound is a glass having a volume resistivity in the range from about $10^{9}$ ohm-cm to about $10^{12}$ ohm-cm at 300° F.

39. The apparatus of claim 21 wherein said passive electrode includes a plurality of mutually spaced electrically conductive segments electrically isolated from each other, and wherein said resistive material covers the surface of each segment facing toward said discharge electrode.

40. The apparatus of claim 39 further including a plurality of insulative spacers positioned between said electrically conductive segments.

41. The apparatus of claim 39 wherein said segments are spaced apart from each other to provide a plurality of interstitial fluid passages therebetween.

42. An electrostatic device having means for suppressing back corona and preventing sparkover, comprising:

a discharge electrode;

a sheet of resistive material positioned adjacent to said discharge electrode having a thickness of at least 0.25 mm, and having a metalized surface opposite the surface of said sheet facing toward said discharge electrode, the 0.25 mm layer of said resistive material facing toward said discharge electrode being devoid of volumes with a dimension larger than 0.006 mm having a volume resistivity substantially lower than the volume resistivity needed to prevent concentration of said corona current such taht said 0.25 mm layer is a substantially homogeneous primary layer having sufficient volume resistivity to suppress back corona and prevent sparkover; and power supply means connected between said discharge electrode and said metalized service for applying a voltage therebetween, said applied voltage being of sufficient magnitude to effect a corona current producing electrostatic field between said discharge electrode and said metalized service.

43. The apparatus of claim 42 wherein the primary layer of said sheet has a volume resistivity in excess of $10^6$ ohm-cm.

44. The apparatus of claim 42 wherein said sheet is composed of an inorganic compound having a dielectric strength greater than 80 kv/cm.

45. The apparatus of claim 42 wherein said entire sheet of resistive material is devoid of volumes with a dimension larger than 0.006 mm having a volume resistivity lower than the volume resistivity needed to prevent concentration of said corona current.

46. The apparatus of claim 42 wherein said sheet is arranged in a cylindrical configuration thereby forming a tubular structure, and wherein said discharge electrode is generally planar and concentrically mounted within said cylindrical sheet, and wherein said metalization extends around the outer surface of said cylindrical sheet adjacent said planar electrode.

* * * * *